US008373341B2

(12) United States Patent
Xue et al.

(10) Patent No.: US 8,373,341 B2
(45) Date of Patent: Feb. 12, 2013

(54) TOP-EMISSION ORGANIC LIGHT-EMITTING DEVICES WITH MICROLENS ARRAYS

(75) Inventors: Jiangeng Xue, Gainesville, FL (US); Elliot Paul Douglas, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 0 days.

(21) Appl. No.: 12/668,464

(22) PCT Filed: Jul. 10, 2008

(86) PCT No.: PCT/US2008/069698

§ 371 (c)(1),
(2), (4) Date: Jan. 11, 2010

(87) PCT Pub. No.: WO2009/009695

PCT Pub. Date: Jan. 15, 2009

(65) Prior Publication Data

US 2010/0201256 A1 Aug. 12, 2010

Related U.S. Application Data

(60) Provisional application No. 60/948,814, filed on Jul. 10, 2007.

(51) Int. Cl.
*H05B 33/00* (2006.01)

(52) U.S. Cl. ..... 313/504; 313/506

(58) Field of Classification Search ..... 313/498–512
See application file for complete search history.

(56) References Cited

U.S. PATENT DOCUMENTS 6,805,902 B1 10/2004 Hayes
6,984,934 B2 1/2006 Möller et al.
2004/0042198 A1* 3/2004 Cok ..... 362/84
2004/0189185 A1 9/2004 Yotsuya
2004/0217702 A1* 11/2004 Garner et al. ..... 313/512
2008/0117519 A1* 5/2008 Chari et al. ..... 359/619

FOREIGN PATENT DOCUMENTS

JP 9171892 A 6/1997
KR 10-2006-0114086 5/2007
KR 10-2007-0049223 5/2007
WO WO-01-33598 5/2001
WO WO 2005-086252 9/2005
WO WO 2006-022273 3/2006

OTHER PUBLICATIONS

Sun. Y., et al., "Organic Light Emitting Devices with Enhanced Outcoupling via Microlenses Fabricated by Imprint Lithography", *Journal of Applied Phys*. 2006, pp. 073106-1 to 073106-6, vol. 100.
Peng, H., "Design and Fabrication of High Efficiency Organic Light Emitting Diodes," *Dissertation given at Hong Kong University of Science and Technology*, 2005, pp. 1-237.

* cited by examiner

*Primary Examiner* — Joseph L Williams
(74) *Attorney, Agent, or Firm* — Saliwanchik, Lloyd & Eisenschenk

(57) ABSTRACT

Embodiments of the invention can provide organic light-emitting devices (OLEDs) with enhanced outcoupling efficiency. Specific embodiments can enhance the outcoupling efficiency by more than four times. Embodiments of the invention incorporate microlens 5 arrays on the emitting surface of a top-emission OLED. Incorporation of microlens arrays on the emitting surface of a top-emission OLED can greatly enhance the outcoupling efficiency in OLEDs. With a microlens array attached to the emitting surface, much of, if not all, of the waveguiding modes can be extracted. The microlens array can be fabricated using the inkjet printing method or using other methods, including molding.

22 Claims, 3 Drawing Sheets

TOP-EMISSION ORGANIC LIGHT-EMITTING DEVICES WITH MICROLENS ARRAYS

CROSS-REFERENCE TO RELATED APPLICATIONS

The present application is the U.S. National Stage Application of International Patent Application No. PCT/US2008/069698, filed on Jul. 10, 2008, which claims the benefit of U.S. Provisional Application Ser. No. 60/948,814, filed Jul. 10, 2007, both of which are hereby incorporated by reference herein in their entirety, including any figures, tables, or drawings.

BACKGROUND OF INVENTION

Organic light-emitting devices (OLEDs) are now being commercialized for use in flat-panel displays and as solid-state lighting sources. The internal quantum efficiency of some state-of-the-art OLEDs can be nearly 100%. However, due to the refractive indices of the organic layers and the substrate being higher than the refractive index of air, the light generated in the organic emissive region can be emitted into three modes as shown in FIG. 1. These three modes include: (i) external modes, which can escape through the substrate; (ii) substrate-waveguiding modes, which extend from the substrate/air interface to the metal cathode; and (iii) ITO/organic-waveguiding modes, which are confined in the ITO (transparent anode) and organic layers. Typically, only about 20% of the energy is contained in the external modes, suggesting a very low light outcoupling efficiency.

Microlens arrays at the substrate/air interface have been used to effectively extract the substrate-waveguiding modes, leading to a reported 50% improvement in the light outcoupling efficiency. Calculations based on ray-optics show that the maximum outcoupling efficiency using this method can be up to 45% when hemispherical microlenses whose refractive index matches that of the substrate are used. This method, however, does not have any effect on the ITO/organic-waveguiding modes as these layers are spatially separated from the microlenses by the substrate.

An example of a conventional OLED structure, or "bottom-emission" device, is shown in FIG. 1, and includes a transparent substrate, a transparent anode (ITO), organic layers, and a reflecting metal cathode. Light is emitted through the substrate in this bottom-emission device. "Top-emission" OLEDs have been made, in which a reflecting electrode is deposited on a substrate followed by the organic layers and a transparent electrode on top. Light is emitted through the top transparent electrode in this geometry. There are only two modes of light emission in the top-emission device, which include (i) the external modes and (ii) the organic/transparent-electrode-waveguiding modes. The outcoupling efficiency is only slightly improved over that of the conventional OLEDs as the amount of light contained in the external modes is mostly determined by the contrast of refractive index between the organic layers and the air, which is not changed by the elimination of the substrate-waveguiding mode.

BRIEF SUMMARY

Embodiments of the invention can provide organic light-emitting devices (OLEDs) with enhanced outcoupling efficiency. Specific embodiments can enhance the outcoupling efficiency by more than four times.

Embodiments of the invention incorporate microlens arrays on the emitting surface of a top-emission OLED. Incorporation of microlens arrays on the emitting surface of a top-emission OLED can greatly enhance the outcoupling efficiency in OLEDs. FIG. 2 shows a specific embodiment of a top-emission OLED utilizing microlens arrays on the emitting surface. Different from the more conventional bottom-emission OLEDs, in the top-emission device, all the light emission generated in the organic layers is now accessible by modifications at the light-emitting surface. With a microlens array attached to the emitting surface, much of, if not all, of the waveguiding modes can be extracted. The microlens array can be fabricated using the inkjet printing method or using other methods, including molding. Preferably, no damage, or negligible damage, is imposed upon the device during the microlens array fabrication/attachment process.

DETAILED DISCLOSURE

Embodiments of the invention can provide organic light-emitting devices (OLEDs) with enhanced outcoupling efficiency. Specific embodiments can enhance the outcoupling efficiency by more than four times.

Figure 1:
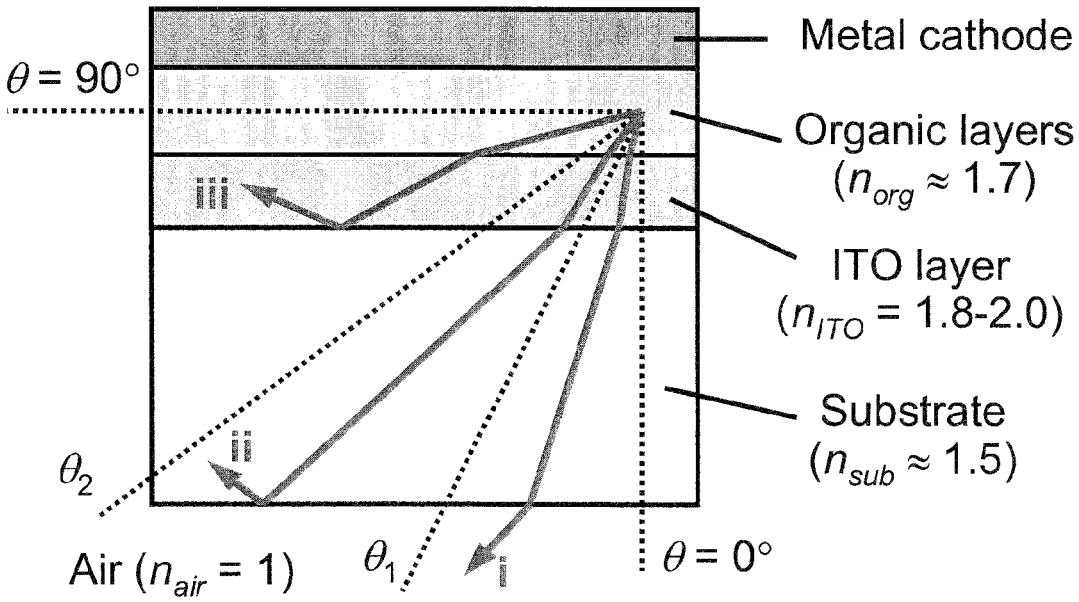
FIG. 1 shows a schematic device structure of an organic light-emitting device and ray diagram of the three types of emission modes: (i) external modes ($0° \leqq \theta \leqq \theta_1$), (ii) substrate modes ($\theta_1 \leqq \theta \leqq \theta_2$), and (iii) ITO/organic modes ($\theta_2 \leqq \theta 90°$).
Figure 2:
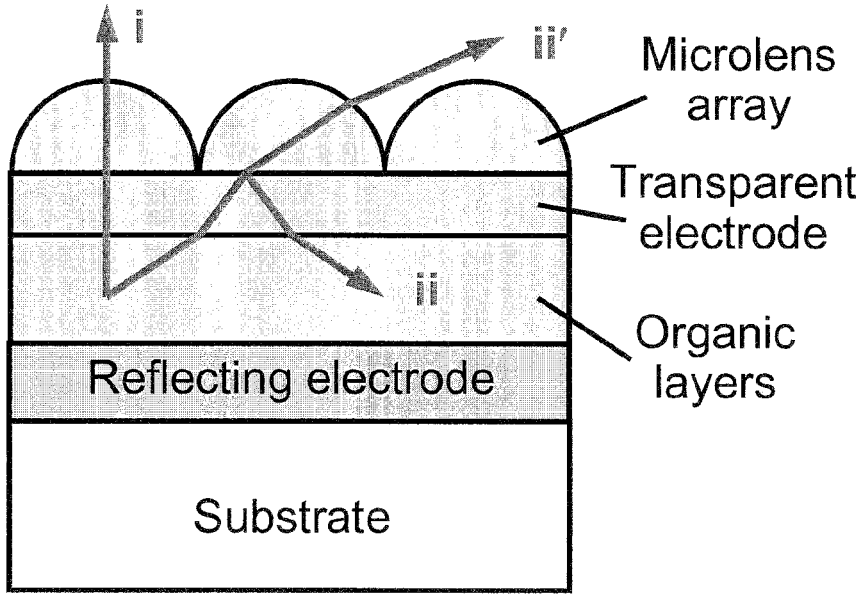
FIG. 2 shows a top-emission OLED device structure (not to scale), where two types of emission modes exist: (i) the external modes and (ii) the organic/transparent electrode-waveguiding modes, where the external modes can be partially extracted with a microlens array on top of the transparent electrode (illustrated as "ii").

Embodiments of the invention incorporate microlens arrays on the emitting surface of a top-emission OLED. Incorporation of microlens arrays on the emitting surface of a top-emission OLED can greatly enhance the outcoupling efficiency in OLEDs. FIG. 2 shows a specific embodiment of a top-emission OLED utilizing microlens arrays on the emitting surface. The top-emission OLED shown in FIG. 2 incorporates a substrate, a reflecting electrode, organic layers, a transparent electrode, and a microlens array. The transparent electrode can have a thickness in the range of 20 nm to 150 nm, and preferably 50 nm-100 nm. The reflecting electrode can be made of, for example, a metal such as aluminum or silver. Alternatively, the reflecting electrode can be a dielectric mirror with a transparent electrode between the dielectric mirror and the organic layers. Different from the more conventional bottom-emission OLEDs, in the top-emission device, all, or most, of the light emission generated in the organic layers is now accessible by modifications at the light-emitting surface in accordance with the subject invention. With a microlens array attached to the emitting surface, much of, if not all, of the waveguiding modes can be extracted. The microlens array can be fabricated using the inkjet printing method or using other methods, including molding. Preferably, no damage, or negligible damage, is imposed upon the device during the microlens array fabrication/attachment process.

In a further embodiment, a layer or a multilayer structure of dielectric materials can be positioned between the transparent electrode and the microlens array. In a preferred embodiment, the dielectric layer(s) is non-conducting and transparent. The dielectric layer(s) can be thick enough to keep moisture and oxygen from passing from the environment to the transparent electrode. In a specific embodiment, the dielectric layer can have a thickness in the range of 0.1 μm to 100 μm. Preferably, the index of refraction of the dielectric layer is greater than or equal to the index of refraction of the organic layers, $n_{org}$. Examples of materials that can be used for the dielectric layer include $SiN_x$, and $AlO_x$.

Figure 3:
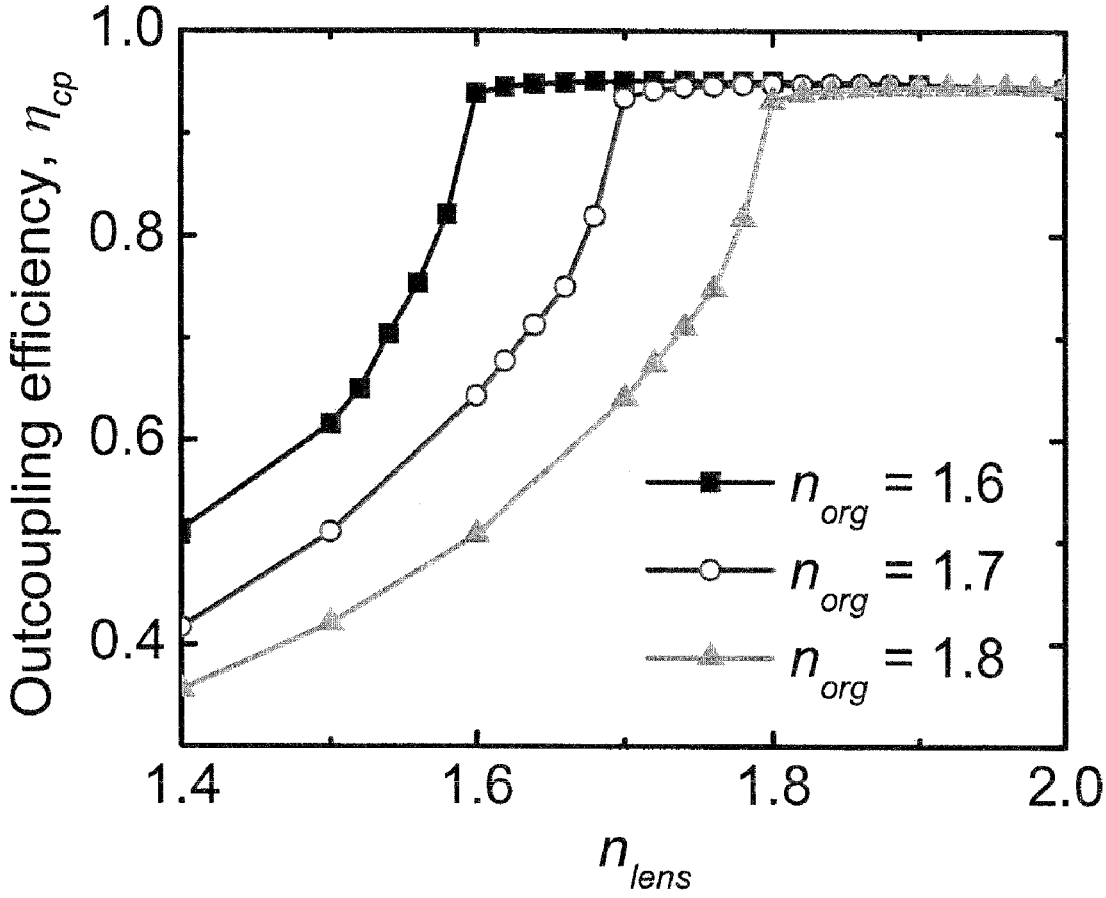
FIG. 3 shows the outcoupling efficiency as a function of the microlens refractive index for the top-emission device based on ray-optics calculations.

As shown in FIG. 3, ray optics calculations show that with an appropriate lens material (refractive index not smaller than that of the organic layers), outcoupling efficiencies as high as 90% can be achieved.

Embodiments of the subject method can improve the light outcoupling efficiency in an OLED by up to four times. Accordingly, embodiment of the subject devices can consume only ¼ of the electricity as consumed by a conventional OLED, while producing the same amount of light. This allows the operating costs of the displays and lighting panels based on OLEDs to be significantly reduced. In addition, by achieving the same luminance at a much lower driving current (or voltage), the lifetime of the devices can be prolonged, by at least four times.

Embodiments of the subject organic light-emitting devices (OLEDs) with very high quantum and power efficiencies can be used for display and lighting applications.

Incorporation of the microlens array does not change the electrical characteristics of a top-emission OLEDs. With lens materials having small dispersion for its refractive index, the enhancement factor can be the same at all wavelengths. Accordingly, embodiments utilizing the microlens array on the emitting surface can be universally applied to monochromatic emission devices, full-color displays, and white-light-emitting OLEDs as solid state lighting sources. Methods of incorporating microlens arrays on the emitting surface can be integrated with existing OLED device fabrication processes.

Figure 4A:
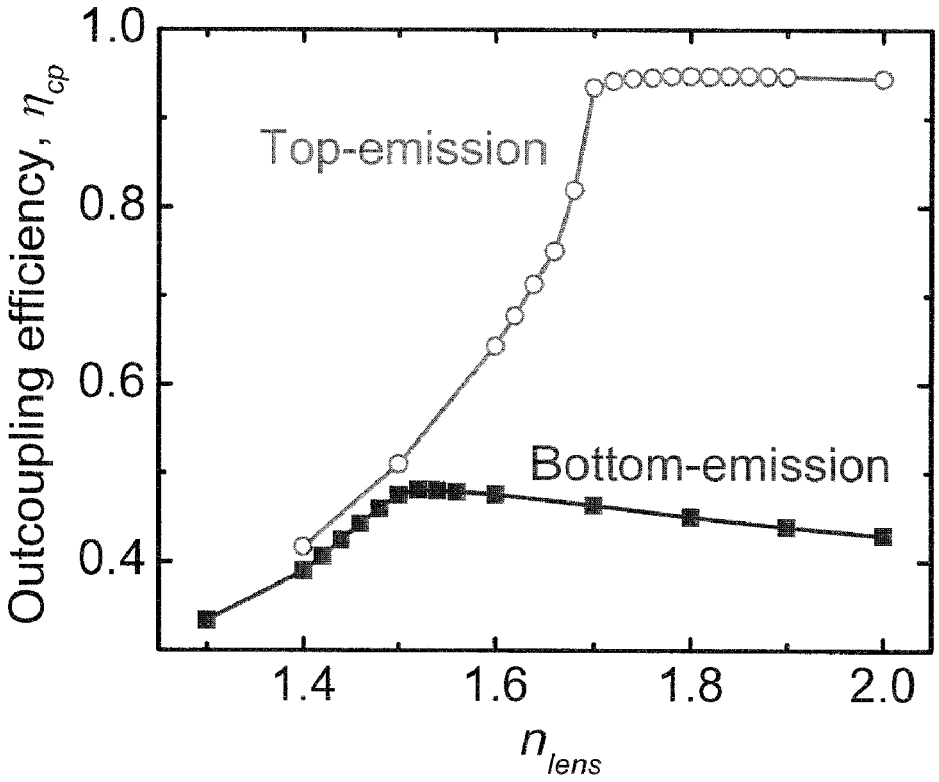
FIG. 4A shows the results of a ray-optics simulation of outcoupling efficiency, $\eta_{cp}$, of an OLED with a hemispherical microlens array as a function of the index of refraction for the microlens material, $n_{lens}$.
Figure 4B:
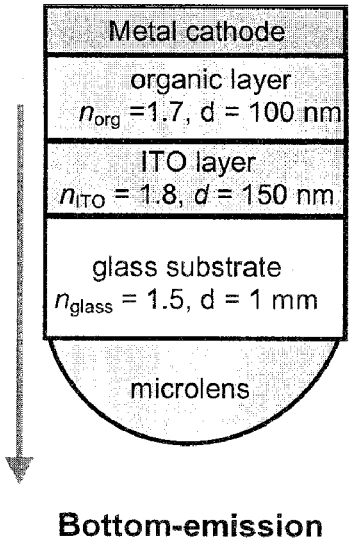
FIG. 4B shows an example of a bottom-emission OLED, the maximum $\eta_{cp}$ of 0.48 is obtained when $n_{lens} \approx n_{sub}$, where $n_{sub}=1.5$ is the index of refraction for the substrate, which is used for the simulation.
Figure 4C:
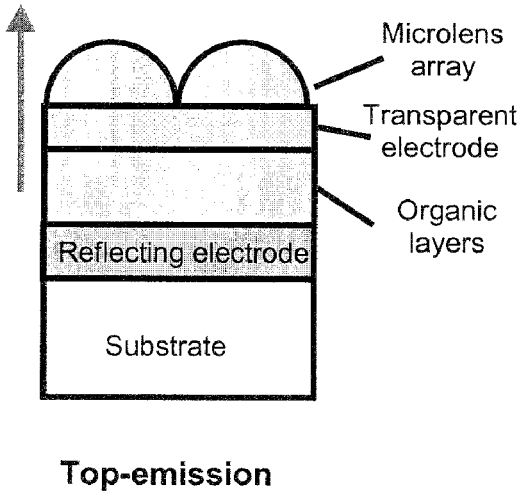
FIG. 4C shows a top-emission OLED, the maximum $\eta_{cp}$ of 0.94 is obtained when $n_{lens} \leqq n_{org}$, where $n_{org}=1.7$ is the index of refraction for the organic layers, which is used for the simulation.

FIG. 4A shows the results of a ray-optics simulation of outcoupling efficiency, $\eta_{cp}$, of an OLED with a hemispherical microlens array as a function of the index of refraction for the microlens material, $n_{lens}$. FIG. 4B shows an example of a bottom-emission OLED, the maximum $\eta_{cp}$ of 0.48 is obtained when $n_{lens} \approx n_{sub}$, where $n_{sub}=1.5$ is the index of refraction for the substrate, which is used for the simulation. FIG. 4C shows a top-emission OLED, the maximum $\eta_{cp}$ of 0.94 is obtained when $n_{lens} \geqq n_{org}$, where $n_{org}=1.7$ is the index of refraction for the organic layers, which is used for the simulation. When the microlens array optimized for the bottom-emission OLED (i.e. $n_{lens} \approx n_{sub}=1.5$) is applied to the top-emission OLED, the outcoupling efficiency is 0.51, which is approximately the same as in the case of bottom-emission (0.48). In alternative embodiments, the index of refraction for the organic layers can be in the range of $1.555 \leqq n_{org} \leqq 1.8$, and preferably in the range of $1.6 \leqq n_{org} \leqq 1.7$. Preferably, but not necessarily, the index of refraction of the microlenses, $n_{lens}$, is greater than or equal to the index of refraction of the organic layers, $n_{org}$.

This is because for use with a bottom-emission OLED, the microlens needs to have an index of refraction matching that of the substrate to achieve the maximum outcoupling efficiency. Using such a microlens array on a top-emission device, the outcoupling efficiency is only minimally increased from 0.48 (bottom-emission) to 0.51 (top-emission) (assuming $n_{sub}=1.5$). Embodiments of the subject OLED incorporate microlens material having an index of refraction close to or larger than that of the organic layers. In a specific embodiment, $n_{org}=1.7$ and the index of refraction of the microlens is close to or larger than 1.7. In specific embodiments, the index of refraction is selected to be close to or larger than the index of refraction of the organic layers so as to achieve ultrahigh outcoupling efficiencies (about 0.9).

Although the embodiment shown in FIG. 2 utilizes a microlens having a hemispherical microlens, other microlens shapes, such as other microlenses having a convex contour, can be utilized in accordance with embodiments of the invention.

A variety of microlens array structures, in a variety of shapes and sizes, are well known in the art and can be incorporated with embodiments of the subject invention. For example, Sturm et al. WO 01/33598 discloses microlenses in the shape of a sphere.

According to WO 01/33598, the total emitted light can be increased by a factor of up to 3, and the normal emitted light can be increased by a factor of nearly 10, through the use of spherical lenses of various radii of curvature on glass or polycarbonate substrates of various thicknesses. Microlenses having a radius of curvature (R) to substrate thickness (T) ratio (R/T) in the range from 1.4 to 4.9 can be utilized with embodiments of the invention. Similarly, Kawakami et al. JP-A-9171892 discloses a spherical lenses shape in which the radius of curvature (R) to substrate thickness (T) ratio (R/T) is about 3.6. Smith et al. WO 05/086252 discloses spherical microlenses in which the radius of curvature (R) to substrate thickness (T) ratio (R/T) is in the range from 0.2 to 0.8. In specific embodiments, the thickness of the substrate can vary and the radius or diameter, d, of the microlenses is maintained in a range, as discussed below.

In an embodiment, forming a microlens on a substrate is accomplished via ink-jet printing. Inkjet printing can be used to form microlenses on the emission substrate. Microlenses can be formed by the deposition of a drop of a polymer in solution where the microlens is formed upon the removal of the solvent. Additionally, microlenses can be formed by the deposition of drops of monomers or polymers with functionality that can be polymerized on a substrate by thermal or photochemical means, for example as disclosed in Hayes, U.S. Pat. No. 6,805,902. Such systems require that the resulting microlens is well attached to the substrate. For LED and OLED applications, it is desirable that a microlens have a large contact angle with a substrate to optimize the proportion of light transmitted from the device. The typical substrate droplet interface displays contact angles that are less than 90 degrees. In various embodiments, microlenses can be formed on a substrate with a contact angle that is about 40 degrees to about 90 degrees. Specific embodiments can utilize partial spheres, with contact angles from about 40 degree to about 90 degrees.

The size, position, and pattern of the microlenses can vary within the scope enabled by, for example, inkjet printing. Hence, lenses of a diameter, d, of as little as about 1 μm to as large as about 500 μm, and preferably in the range 10 $\mu m \leqq d \leqq 100$ μm, can be formed on the OLED or LED emission substrate with spacing between lenses that can be as small as about 1 μm or less. In a preferred embodiment, there is no spacing between microlenses.

Patterns of microlenses in microlens arrays can vary and multiple sized lenses can be included in the arrays. Patterns need not be regular or periodic but can be irregular, quasiperiodic or random.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

The invention claimed is:

1. An organic light-emitting device, comprising:

a substrate;

at least one light emission layer, wherein the at least one light emission layer comprises at least one organic material;

a reflecting electrode positioned between the substrate and the at least one light emission layer;

a microlens array; and a transparent electrode positioned between the microlens array and the at least one light emission layer, wherein the microlens array is positioned on an emitting surface of the organic light-emitting device, wherein the emitting surface is an outer surface of the transparent electrode, wherein the microlens array increases the outcoupling efficiency of light out of the device, wherein the index of refraction of the microlens array is greater than or equal to the index of refraction of the at least one light emission layer.

2. The device according to claim 1, wherein the reflecting electrode comprises a metal.

3. The device according to claim 1, wherein the reflecting electrode comprises a dielectric mirror and a second transparent electrode positioned between the dielectric mirror and the at least one light emission layer.

4. The device according to claim 1, wherein the transparent electrode has a thickness in the range of 50 nm to 100 nm.

5. The device according to claim 1, wherein the index of refraction of the at least one light emission layer is in the range of 1.6 to 1.7.

6. The device according to claim 1, wherein the microlenses of the microlens array have a hemispherical shape.

7. The device according to claim 1, wherein the microlenses of the microlens array make a contact angle.

8. The device according to claim 1, wherein the microlenses of the microlens array have a convex contour with respect to the emitting surface.

9. The device according to claim 1, wherein the microlenses of the microlens array are each a portion of a sphere.

10. The device according to claim 1, wherein the diameters of the microlenses of the microlens array are in the range of 10 μm to 500 μm.

11. The device according to claim 1, wherein the diameters of the microlenses of the microlens array are in the range of 1 μm to 100 μm.

12. The device according to claim 1, wherein the spacing between microlenses of the microlens array is less than or equal to 1 μm.

13. The device according to claim 1, wherein there is no spacing between microlenses of the microlens array.

14. The device according to claim 1, wherein the substrate comprises glass or plastic or metal foils.

15. The device according to claim 1, wherein the microlenses of the microlens array are produced via ink printing.

16. The device according to claim 1, wherein the microlenses of the microlens array are produced via molding.

17. The device according to claim 1, wherein the outcoupling efficiency of light out of the device is at least 0.5.

18. The device according to claim 1, wherein the outcoupling efficiency of light out of the device is at least 0.9.

19. The device according to claim 1, wherein the microlens array positioned on the emitting surface extracts light that would be in waveguiding modes without the microlens array.

20. The device according to claim 1, wherein the microlens array is positioned such that an interface is created between each microlens of the microlens array and the emitting surface such that at least a portion of light exiting through the emitting surface directly enters a microlens.

21. The device according to claim 1, wherein the index of refraction of the microlens array is greater than 1.5.

22. An organic light-emitting device, comprising:

a substrate;

at least one light emission layer, wherein the at least one light emission layer comprises at least one organic material;

a reflecting electrode positioned between the substrate and the at least one light emission layer;

a microlens array;

a transparent electrode positioned between the microlens array and the at least one light emission layer; and a dielectric layer positioned between the microlens array and the transparent electrode, wherein the dielectric layer reduces the passing of oxygen and moisture from the environment to the transparent electrode, wherein the microlens array is positioned on an emitting surface of the organic light-emitting device, wherein the emitting surface is an outer surface of the dielectric layer, wherein the microlens array increases the outcoupling efficiency of light out of the device, wherein the index of refraction of the microlens array is greater than or equal to the index of refraction of the at least one light emission layer.

* * * * *

UNITED STATES PATENT AND TRADEMARK OFFICE

CERTIFICATE OF CORRECTION

PATENT NO. : 8,373,341 B2
APPLICATION NO. : 12/668464
DATED : February 12, 2013
INVENTOR(S) : Jiangeng Xue and Elliot P. Douglas It is certified that error appears in the above-identified patent and that said Letters Patent is hereby corrected as shown below:

In the Specification

Column 2,

Line 22, "$(0° \leqq \theta \leqq \theta_1)$" should read --$(0° \leq \theta \leq \theta_1)$--.

Line 23, "$(0_1 \leqq \theta \leqq \theta_2)$" should read --$(0_1 \leq \theta \leq \theta_2)$--.

Line 23, "$(\theta_2 \leqq \theta 90°)$" should read --$(\theta_2 \leq \theta \leq 90°)$--.

Line 42, "$n_{lens} \geqq n_{org}$" should read --$n_{lens} \geq n_{org}$--.

Column 3,

Line 58, "$n_{lens} \geqq n_{org}$" should read --$n_{lens} \geq n_{org}$--.

Line 66, "$1.555 n_{org} \leqq 1.8$" should read --$1.55 \leq n_{org} \leq 1.8$--.

Line 67, "$1.6 \leqq n_{org} \leqq 1.7$" should read --$1.6 \leq n_{org} \leq 1.7$--.

Column 4,

Line 67, "$\mu m \leqq d \leqq 100$" should read --$\mu m \leq d \leq 100$--.

Signed and Sealed this
Eleventh Day of June, 2013

Teresa Stanek Rea
*Acting Director of the United States Patent and Trademark Office*